United States Patent [19]

Mammen

[11] 4,238,668

[45] Dec. 9, 1980

[54] ELECTROSTATIC OVEN

[75] Inventor: H. William Mammen, Hillside, Ill.

[73] Assignee: Sunbeam Corporation, Chicago, Ill.

[21] Appl. No.: 774,194

[22] Filed: Mar. 3, 1977

[51] Int. Cl.[3] ..... F24C 7/00

[52] U.S. Cl. ..... 219/399; 165/96; 165/1; 219/392; 219/402; 219/404

[58] Field of Search ..... 219/386–392, 219/395–403, 281, 280, 10.81; 165/1, 2, 95, 96; 174/16 R; 361/229, 299

[56] References Cited

U.S. PATENT DOCUMENTS

| | | | |
|---|---|---|---|
| 1,835,557 | 12/1931 | Burke | 361/229 |
| 1,980,821 | 11/1934 | Palyeff | 174/16 R |
| 2,228,136 | 1/1941 | Hart, Jr. | 219/10.81 |
| 2,401,277 | 5/1946 | Stratton | 219/10.81 |
| 2,605,377 | 6/1952 | Kaehni et al. | 219/281 |
| 3,056,587 | 10/1962 | Steigerwald | 219/280 |
| 3,240,994 | 3/1966 | Stuetzer | 361/299 |
| 3,370,644 | 2/1968 | Dailey et al. | 165/1 |
| 3,578,949 | 5/1971 | Weyrick | 219/395 |
| 3,702,919 | 11/1972 | Candor et al. | 219/393 |
| 3,794,111 | 2/1974 | Blomgren, Sr. et al. | 165/96 |
| 3,935,321 | 1/1976 | Sakler et al. | 62/62 |
| 4,015,658 | 4/1977 | Kibler et al. | 165/1 |

FOREIGN PATENT DOCUMENTS 1579487 6/1975 Fed. Rep. of Germany .

749202 5/1956 United Kingdom .

*Primary Examiner*—Gerald P. Tolin
*Assistant Examiner*—Bernard Roskoski
*Attorney, Agent, or Firm*—Mason, Kolehmainen, Rathburn & Wyss

[57] ABSTRACT

An electrostatic oven or cooking apparatus having a heating structure defining a cavity and conventional thermostatically controlled heating element into which articles are placed is provided with an arrangement to generate an electrical field in a direction substantially perpendicular to the plane of the cooking articles thereby improving the overall efficiency of the cooking process. The improved efficiency of the cooking process results in a reduction in the cooking time relative to conventional ovens. The electrical field generating apparatus in one arrangement includes an electrical field grid element maintained at a reference potential and apparatus for supporting the cooking articles upon being positioned within the heating structure cavity and maintaining the cooking articles at a DC potential with respect to the reference potential. The electrical field grid element and the cooking article support apparatus are spaced apart and adjustable relative to each other. A safety interlock device is provided to prevent energization of the electrical field generating arrangement whenever the door is not properly closed.

3 Claims, 2 Drawing Figures

ELECTROSTATIC OVEN

BACKGROUND OF THE INVENTION

A. Field of the Invention

The present invention relates most generally to the field of cooking apparatus and heating ovens and more particularly to an electrostatic oven and an electrical field generating arrangement provided within an oven to improve the overall efficiency of the cooking process by improving the heat transfer to articles within the oven.

B. Description of the Prior Art

In cooking apparatus, it is desirable to increase the efficiency of the cooking process both as to the cooking time for a particular comestible or article and as to the energy to accomplish the cooking process. In a conventional electrical oven configuration, thermal energy generated, for example, from a thermostatically controlled heating element is transmitted by conduction and convection to the comestible article being cooked. During the cooking process, it has been found that a thin insulating stagnant layer of air adheres to or surrounds the article. This stagnant layer of air reduces cooking efficiency by increasing the thermal path resistance to the article.

While various oven configurations of the prior art are generally suitable for their intended purpose and have been proposed to increase efficiency and reduce cooking times, they are either more expensive than conventional ovens as is the situation regarding microwave (electromagnetic radiation) ovens or require increased energy consumption and/or undesirable components to improve cooking times. For example, a circulating fan may be utilized in a conventional oven with a thermostatically controlled heating element to remove the stagnant insulating layer surrounding the article being cooked. However, the fan requires additional energy and presents a complex problem concerning the direction and quantity of air flow to remove the insulating layer. Further, the forced air cooking process does not result in a substantial reduction in cooking time. Fans are also a maintenance problem and considered undesirable in many applications.

Many arrangements of the prior art have been proposed to increased energy transfer to or from fluids and in heat exchanger apparatus by the use of an electrostatic field. Typical of this heat exchanger apparatus are U.S. Pat. Nos.: 3,370,644 which issued to W. B. Dailey et al on Feb. 27, 1968; 2,605,377 which issued to W. L. Kaehmi et al on July 29, 1952; 3,794,111 which issued to O. C. Blomgren, Sr. et al on Feb. 26, 1974; 1,980,821 which issued to K. K. Palueff on Nov. 13, 1934; 1,835,557 which issued to S. P. Burke on Dec. 8, 1931; 3,629,584 which issued to O. C. Blomgren, Jr. on Dec. 21, 1971; 3,747,284 which issued to F. J. Lyczko on July 24, 1973; 3,578,072 which issued to H. H. Kolm on May 11, 1971; 3,771,233 which issued to P. French et al on Nov. 13, 1973; and 3,056,587 which issued to K. H. Steigerwald on Oct. 2, 1962. While the above arrangements are useful in increasing energy transfer in heat exchanging applications, they do not provide apparatus or a method for improving the efficiency of a cooking process and reducing cooking time.

SUMMARY OF THE INVENTION

Accordingly, it is a principal object of the present invention to provide cooking apparatus that efficiently reduces the cooking time for comestibles.

Another object of the present invention is to provide an arrangement for use with a conventional oven having a thermostatically controlled heating element to improve the efficiency of heat transfer in the cooking process.

Another object of the present invention is to provide apparatus in a cooking oven for reducing the cooking time of comestibles with negligible increased energy requirements while the oven is operating and with a net energy saving in the overall cooking process.

A further object of the present invention is to provide apparatus for establishing an electrical field in a thermostatically controlled cooking oven and in a direction substantially perpendicular to the plane of the cooking articles.

A still further object of the present invention is to provide an electrical field grid element maintained at a reference potential adjacent a cooking article support arrangement maintained at a DC potential with respect to the reference potential to improve the overall efficiency of a cooking process.

These and other objects of the present invention are efficiently achieved through the provision of apparatus in a thermostatically controlled oven to generate an electrical field in a direction substantially perpendicular to the plane of the cooking articles. The electrical field generating apparatus in one arrangement includes an electrical field grid element maintained at a reference potential and positioned adjacent apparatus for supporting the cooking articles and maintaining the cooking articles at a DC potential with respect to the reference potential. The electrical field grid element and the conductive cooking article support apparatus are adjustable relatively to each other to provide a specific electric field condition without arcing conditions. The electrical field generating apparatus is selectively operable independently of the thermostatically controlled heating element or elements by the provision of a field switch to provide for normal oven operation without the field generating apparatus for certain comestibles or for operation during a portion of the cooking time. A safety interlock device prevents operation of the field generating apparatus when the door is not properly closed.

BRIEF DESCRIPTION OF THE DRAWINGS

The invention, both as to its organization and method of operation, together with further objects and advantages thereof will best be understood by reference to the following detailed description taken in connection with the accompanying drawings wherein.

DETAILED DESCRIPTION OF THE PREFERRED EMBODIMENT

Figure 1:
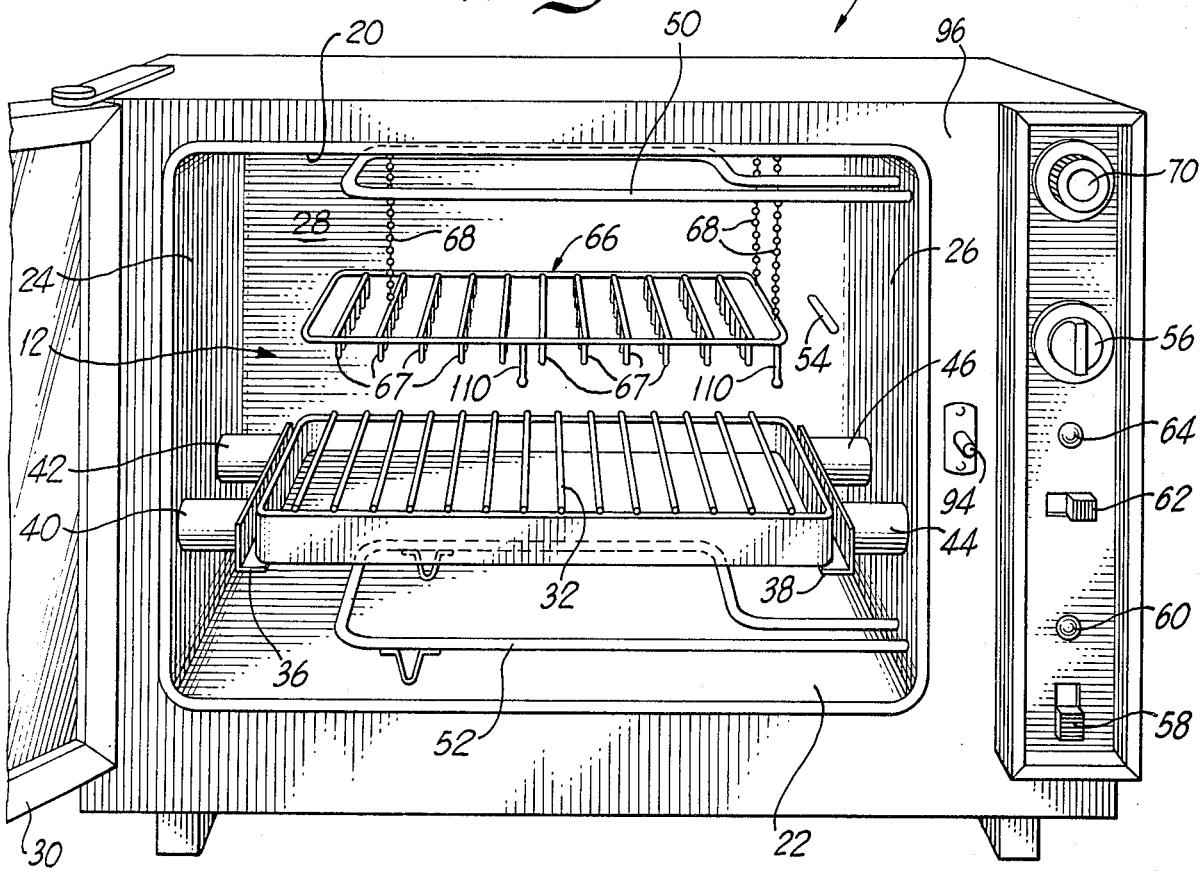
FIG. 1 is a front perspective view of cooking apparatus constructed in accordance with the principles and teachings of the present invention.
Figure 2:
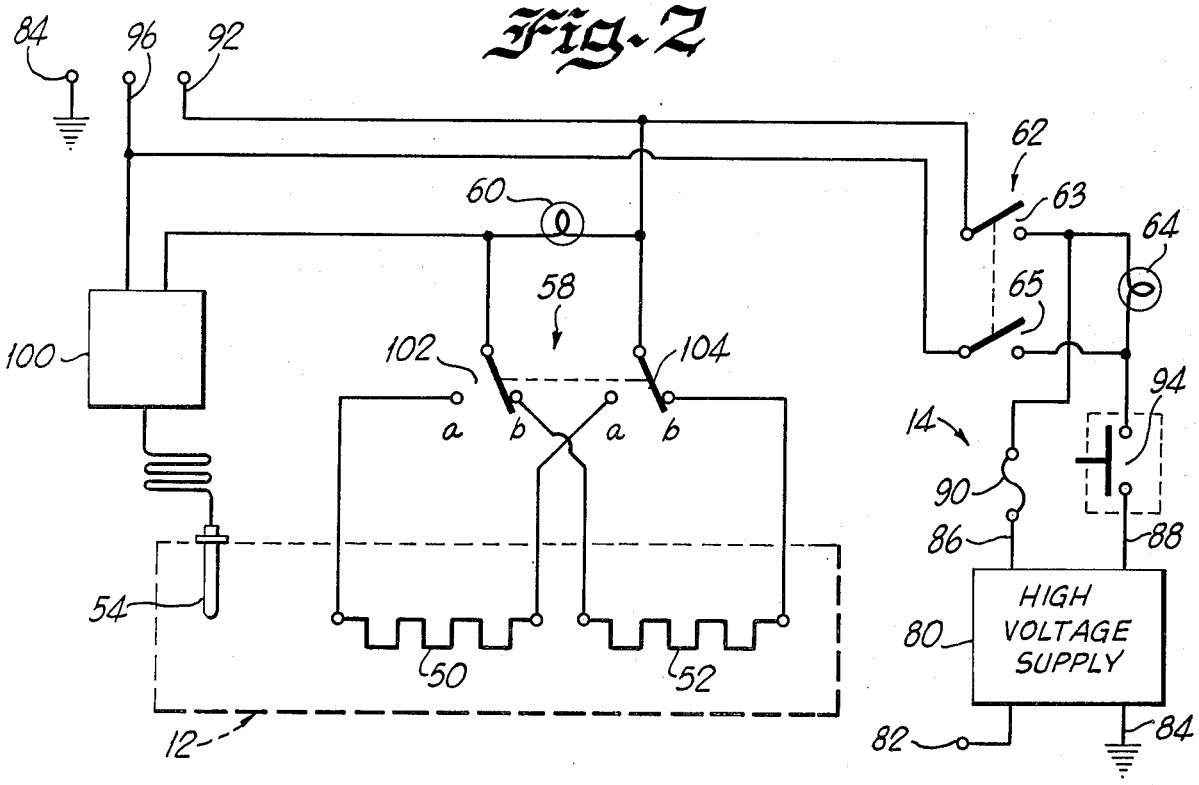
FIG. 2 is an electrical schematic drawing of the cooking apparatus of the present invention of FIG. 1.

Referring now to FIGS. 1 and 2 there is shown a new and improved cooking apparatus or oven referred to generally at 10 and constructed in accordance with the features and principles of the present invention. The cooking apparatus 10 is designed to accept food items or comestibles inside a heating cavity referred to generally at 12 defined by the insulated and connecting boundary elements including a top surface 20, left and right side walls 24, 26, a bottom surface 22 and a back surface 28. The surfaces 20, 22, 24, 26 and 28 define a rectangular cavity and oven structure in combination with a hinged door 30 that includes a double insulated glass window. The comestibles or food articles are carried and positioned by a metallic drip pan arrangement with a wire supporting rack referred to generally as 32 or alternatively on a metal tray (not shown). The drip pan arrangement 32 or the tray is supported within the oven cavity 12 by extending support and guide ledges 36 and 38 which are attached to the side walls 24, 26 through insulator elements 40, 42 and 44, 46 respectively whose purpose will be explained in detail hereinafter. The insulators 40, 42, 44 and 46 in a specific embodiment are fabricated from ceramic material. In an alternate arrangement, the support and guide ledges 36 and 38 may form a continuous support across the width of the oven cavity 12. The drip pan arrangement 32 is most suitable for meat and roasts, and may also be used without the wire rack. The tray is useful for pot pies, cookies, cake pans, pizza, rolls and TV dinners.

The cooking apparatus 10 is provided with an upper heating element 50 and a lower heating element 52 which are thermostatically controlled by a sensor element 54 located within the cavity 12 as is common in conventional electrical cooking ovens. The temperature of the oven is controlled by an adjustment knob or control 56. The selective operation of the upper and lower heating elements 50 and 52 is controlled by a selector switch 58 corresponding to respective "broil" or "bake" modes of operation. An amber indicator light 60 is provided adjacent the control 58 to indicate when either of the heating elements 50 or 52 are activated.

In accordance with important aspects of the present invention, the cooking apparatus 10 is provided with an electrical field generating arrangement referred to generally at 14 (FIG. 2) which is controlled by a field selector switch 62. The operation of the electrical field generating arrangement 14 is displayed by a red indicator light 64. A planar field grid element 66 is suspended within the oven cavity 12 in a plane generally parallel to the plane of the cooking articles and by a number of beaded chains 68. The field grid element 66 and the beaded chains 68 are raised and lowered by the respective clockwise and counterclockwise rotation of a grid height adjustment control 70. The chains 68 are wound and unwound about the shaft of the control 70 as the control is rotated. The field grid element 66 is fabricated from an electrically conductive material and is formed with a number of extending grid points 67 in a grid array or pattern. The grid points 67 are maintained at a DC reference potential which in a preferred embodiment is also the reference potential of the oven cavity walls.

In accordance with further important aspects of the present invention, the support and guide ledges 36, 38 are fabricated from an electrically conductive material and are maintained at a DC potential with respect to the reference potential. In a specific embodiment the DC potential difference between the grid points 67 of the field grid element 66 and the support and guide ledges 36 and 38 is approximately 15,000 volts with the support and guide ledges being positive with respect to the grid element 66.

The DC potential is applied to the support and guide ledges 36 and 38 through several of the insulator elements 40, 42, 44 and 46. In the specific embodiment where the support and guide ledges 36 and 38 are formed as one continuous element across the width of the apparatus cavity 12, the DC potential is supplied through only one of the insulators 40, 42 44 or 46. The DC potential is generated at an output 82 of a high voltage power supply 80 of the electrical field generating arrangement 14. The power supply 80 is a conventional circuit arrangement that converts a 120 VAC supply input on lines 86, 88 to a high voltage DC output such as 15,000 volts. Voltages in the range of 10,000 to 30,000 volts have been found suitable to practice the invention with the most effective voltages being determined by such factors as the size of the oven cavity and the food articles being cooked. The design of the supply 80 in a specific embodiment includes a step-up transformer and a filtering network. The output 82 is connected to the support and guide ledges 36 and 38 as described hereinbefore while the grid element 66 is connected to the reference potential 84 of the supply 80.

The output lead 86 of the high voltage power supply 80 is connected through a fuse 90 and through a first pole or contact pair 63 of the field switch 62 to one line 92 of a conventional 120 VAC supply input. The field switch 62 is a double pole-single throw configuration (DPST). The second input 88 to the high voltage power supply 80 is connected through a safety interlock switch 94 and the second pole or contact pair 65 of the field switch 62 to the paired line 96 of the 120 VAC supply. The safety interlock switch 94 is mounted along a front lip 96 of the cooking apparatus 10 so as to be operatively contacted when the door 30 is securely closed. Thus, after switch 62 is operated, power can only be connected to the high voltage power supply 80 when the door 30 is in a predetermined properly closed position contacting the safety interlock 94 to prevent any potential hazards. The field indicator light 64 is connected across the switch contacts of switch 62 so as to be actuated when the switch is closed.

The 120 VAC supply input pair 92 and 96 are also connected to supply the heating elements 50 and 52 through the element selector switch 58. The supply line 96 is connected through a thermostatic switch arrangement 100 to the center or common contact of one pole 102 of the element switch 58 which is a double pole-double throw configuration (DPDT). The thermostatic switch 100 is controlled by the temperature sensor 54 with the combination of the sensor 54 and thermostatic switch 100 operating in a conventional manner to control the cavity temperature as selected by the temperature adjustment control 56 which is operatively connected to the thermostatic switch 100. The temperature adjustment control 56 also includes an off position detent.

The paired 120 VAC supply line 92 is connected to the center or common contact of the second pole 104 of the element selector switch 58. The heating indicator light 60 is connected between the two center contacts of the poles of the switch 58. The upper heating element 50 is connected across a first contact position "a" of poles 102 and 104 of the switch 58 and the lower heating element 52 is connected across the second contact position "b" of poles 102 and 104. Thus, when the switch 58 is in the "a" position, the upper heating element 50 is energized through the thermostatic switch 100. Similarly, when the switch 58 is in the "b" position, the lower heating element 52 is energized through the thermoplastic switch 100.

In operation, either the upper or lower heating element 50 or 52 is selected and maintains the cavity 12 at the selected elevated cooking temperature. Comestibles placed on the drip pan arrangement 32 or the tray and supported on the ledge 36, 38 are subjected to the oven temperature and cooking proceeds. The thermal energy generated by either the upper or lower heating elements 50 or 52 is transmitted by convection and conduction to the comestibles. While cooking proceeds, the thermal energy must traverse a thin insulating layer of stagnant air that builds up or adheres to the surface of the article being cooked.

In accordance with an important aspect of the present invention and with the field switch 62 in the on position, an electrical field is created within the oven cavity 12 between the grid points 67 of the field grid elements 66 and the comestible article carried by the rack 32 or the tray in a direction substantially perpendicular to the plane of the comestibles and the rack 32 or the tray. The fluid particles in the stagnant insulative layer are ionized and moved away by the generated electrical field. Thus, the thermal energy transfer of the cooking process is increased with a corresponding reduction in the cooking time. Reduction in cooking times in the range of 10% to 50% have been observed. Since the generation of the electrical field requires only a small amount of power, less than 25 watts in a specific embodiment, the overall energy efficiency of the cooking process has also been improved. In effect the stagnant insulating layer that decreases thermal energy transfer has been removed or stripped away.

The adjustment of the field generating arrangement 14 is accomplished by moving the grid element 66 to the top of the oven cavity 12 and the top of the adjustment range by rotation of control 70 either before or after the comestibles are positioned in the cavity 12 and one of the heating elements 50 or 52 has been energized. The field switch 62 is moved to the on position energizing the electric field and actuating the red indicator light 64, assuming the door 30 is securely closed. The grid element height adjustment control 70 is then rotated to lower the grid element 66 until the grid points 67 are approximately three/quarters of an inch away from the plane of the comestibles being cooked. If arcing occurs, the grid element is raised slightly until the arcing is eliminated.

In accordance with further important aspects of the present invention and in a specific embodiment, an adjustment range of six inches for the grid element 66 has been found suitable and the projection of the grid points 67 are preferably three/eights of an inch. Further, the grid element 66 is formed with a plurality of rows and columns of grid points 67 such as a 10×10 array for a grid element with dimensions of approximately 9″×13″ and an oven cavity of approximately 12″×17½″. Spacing elements 110 fabricated from a non-conductive heat resistant materialy may also be provided extending downwardly from and carried by the grid element 66 in the same general direction of the grid point projection 67 to provide an aid for the operator to determine the proper distance from the comestibles to simplify the adjustment procedure.

Other specific embodiments are also contemplated concerning the electrical field generating apparatus 14. For example, the electrically isolated support and guide ledges 36, 38 may be utilized solely for the physical support of the cooking articles and a planar field element provided below the plane of the cooking articles and maintained at a DC potential with respect to the reference potential of the field grid element. Preferably, in this specific embodiment the cooking article support corresponding to the drip pan arrangement 32 or the tray is fabricated from a non-conductive heat resistant material. Further, if a charged planar field element is provided below the plane of the cooking articles, the field element may be fabricated as a grid array similar to the field grid element 66. It should also be understood that in another specific embodiment, the grid element 66 may also be maintained at a DC potential above the cooking article support apparatus or the lower field element.

While there has been illustrated and described several embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. Apparatus for cooking food products, comestibles and like articles comprising:

a heating structure defining a closable cavity into which at least one article to be heated is positioned and including a thermostaticallycontrolled electric heating element for heating said articles and a pivotally mounted door for closing an opening to said cavity;

a fixed conductive shelf for fixedly positioning and supporting the article within said closable heating structure cavity and defining an article cooking plane; said fixed shelf being supported by a conducting guide surface extending into the cavity and insulating mounting means positioned between said heating structure and said guide surface for electrically isolating said guide surfaces; and means adapted to be connected to a power source for generating an electrical field within said closable heating structure cavity, said electrical field being oriented substantially perpendicular to the article cooking plane, means connected to said door to deenergize said field generating means whenever said door is open, said electrical field generating means comprising means for maintaining said fixed shelf at a first DC potential and a planar field grid element having an area substantially equal to the area of the fixed conductive shelf disposed within said cavity and being connected to an external control means for selectively adjusting the relative distance between the article to be cooked and the planar field grid element upon operation of the selectively adjusting external control means, said planar field grid element being maintained at a second DC potential with respect to said first DC potential for completing said electrical field to the article cooking plane to substantially immerse a comestible within said electric field for improved heat transfer from the electric heating element and the cavity to the comestible being cooked.

2. The apparatus of claim 1 wherein said external control means comprises a manual control connected to a flexible support element which vertically moves said planar field grid element within said closable cavity over a selected range of movement while maintaining said planar field grid element in a substantially horizontal orientation.

3. Apparatus for cooking food products, comestibles and like articles comprising:

a heating structure defining a selectively closable cavity into which at least one article to be cooked is positioned and including an electric heating element for heating said article and having a door pivotally mounted thereon;

a fixed shelf defining a substantially horizontal article cooking plane plane and comprising a planar conductive article tray interfitting with a plurality of conductive guide surfaces extending from said heating structure into the selectively closable cavity and insulative mounts positioned between said heating structure and said conductive guide surfaces for electrically isolating said guide surfaces; and means adapted to be connected to a power source for generating an electrical field within said closable heating structure cavity, said electrical field being oriented substantially perpendicular to the article cooking plane, means connected to said door to deenergize said field generating means whenever said door is open, said electrical field generating means comprising means for maintaining said shelf at an elevated DC potential equal to the potential of the cavity and positioning the field grid element in a substantially horizontal orientation suspended from a plurality of flexible elements to provide vertical movement of said planar field grid element with respect to said article cooking plane while maintaining a substantially parallel attitude between said article cooking plane and the planar field grid element and manually operable means external of said cavity to permit manual raising and lowering of said field grid element.

* * * * *